US007005583B2

(12) United States Patent
Varkey et al.

(10) Patent No.: US 7,005,583 B2
(45) Date of Patent: Feb. 28, 2006

(54) ELECTRICAL CABLE AND METHOD OF MAKING SAME

(75) Inventors: Joseph P. Varkey, Missouri City, TX (US); Byong J. Kim, Sugar Land, TX (US); Willem A. Wijnberg, Houston, TX (US); Chun-Te Yeh, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/423,716

(22) Filed: Apr. 25, 2003

(65) Prior Publication Data

US 2004/0045735 A1 Mar. 11, 2004

Related U.S. Application Data

(60) Provisional application No. 60/409,563, filed on Sep. 10, 2002.

(51) Int. Cl.
*H01B 7/00* (2006.01)

(52) U.S. Cl. ..... 174/120 R

(58) Field of Classification Search ..... 174/120 R, 174/120 SR, 117 A
See application file for complete search history.

(56) References Cited

U.S. PATENT DOCUMENTS 4,132,857 A 1/1979 Scarola et al.
4,327,248 A 4/1982 Campbell
5,414,217 A * 5/1995 Neuroth et al. ..... 174/120 R
5,426,264 A * 6/1995 Livingston et al. ..... 174/102 R
5,734,773 A * 3/1998 Teshima et al. ..... 385/126
5,942,731 A * 8/1999 Rogerson ..... 174/163 R
6,262,182 B1 * 7/2001 Eagan et al. ..... 525/285
6,359,230 B1 * 3/2002 Hildreth ..... 174/110 R
2003/0044606 A1 * 3/2003 Iskander ..... 428/375

FOREIGN PATENT DOCUMENTS

GB 2144901 A 3/1985

* cited by examiner

*Primary Examiner*—Chau N. Nguyen
(74) *Attorney, Agent, or Firm*—Robin Nava; Brigitte L. Echols

(57) ABSTRACT

An electrical cable includes a first layer, a second layer, and a tie layer, disposed between the first layer and the second layer, for bonding the first layer to the second layer. A method of making an electrical cable includes applying a tie layer to an inner layer, the tie layer being miscible with the inner layer, and bonding an outer layer to the tie layer via one of a chemical reaction therebetween and a physical bond therebetween. An electrical cable includes a first layer, a second layer immiscible with the first layer, and a tie layer disposed between the first layer and the second layer, wherein the tie layer is miscible with the first layer and is capable of bonding with the second layer.

7 Claims, 3 Drawing Sheets

ELECTRICAL CABLE AND METHOD OF MAKING SAME

CROSS-REFERENCE TO RELATED APPLICATIONS

This application claims priority from Provisional Application 60/409,563, filed Sep. 10, 2002, which is incorporated herein by reference.

BACKGROUND OF THE INVENTION

1. Field of the Invention

This invention relates to electrical cabling and, more particularly, to an electrical cable having a tie layer disposed between a first layer and a second layer and a method for manufacturing same.

2. Description of Related Art

Many electrical cables, such as seismic, oceanographic, and wireline cables, are sometimes used in corrosive environments at pressures that may range from atmospheric to very high and at temperatures that may range from arctic to very high. Accordingly, the insulating and jacketing materials used in such cables must be able to withstand these harsh environments, as well as have the dielectric and capacitive properties desirable for the cables. Polymers belonging to the polyolefin family, such as polyethylene, polypropylene, and polyethylene propylene co-polymer, and polymers belonging to the fluoropolymer family, such as ethylene tetrafluoroethylene, fluorinated ethylene propylene, polytetrafluoroethylene/perfluoromethylvinylether co-polymer, and perfluoroalkoxy polymer, are commonly used as insulating materials in these cables.

It is often desirable to have multiple layers of insulating and jacketing materials surrounding the conductors in seismic, oceanographic, and other electrical cables so that the cable will have the desired electrical properties and be able to withstand the environment in which it is used. Generally, it is also desirable to bond or "pot" the insulating layers to a connector or the like within a cable termination to inhibit moisture or other contaminants from penetrating between the insulating layers and/or from entering the connector. Polyolefin and fluoropolymer materials, however, may not bond well to conventional epoxy, nitrile, ester, or urethane-based potting compounds. In general, only cyanoacrylate adhesives are effective in bonding these materials in electrical cable applications. Cyanoacrylate adhesives, however, may be brittle and may be unable to withstand the pressure and/or temperature cycling encountered by such cables.

Primers have been used to enhance the bonding, but they are not as effective on polyolefin and fluoropolymer materials as on other polymeric materials. Surface treatments, such as flame treatment, corona discharge, and solvent etching, have been used to enhance the bonding characteristics of polyolefin and fluoropolymer materials. These techniques, however, may be time consuming and impractical in certain situations. For example, it may be difficult to apply these treatments to large numbers of small, insulated conductors that are bundled together. As a result, such surface treatments may provide results that are less than optimal.

Multiple layers of different potting materials have also been used to overcome the bonding problems of polyolefin and fluoropolymer materials. However, this process has proven to be difficult and time consuming. In some situations the layers of potting material may not effectively bond together, which provides the potential for moisture ingression. Further, a longer length cable termination results from this process, which is generally undesirable.

When the insulating layer and the jacketing layer are not properly bonded together, such as in a cable having a polyvinylchloride insulating layer with a nylon jacketing layer, a small, often microscopic void or voids may exist between the insulating layer and the jacketing layer, which may allow wicking of fluids therein. Moreover, mechanical flexing of such layers having a void or voids therebetween may cause wrinkling and separation of the layers, inhibiting the usefulness of the cable.

Some conventional electrical cables have utilized insulating and jacketing materials that have better bonding characteristics than polyolefin and fluoropolymer materials, such as nylon and thermoplastic polyester elastomers (e.g., Hytrel®, manufactured by E. I. du Pont de Nemours and Company of Wilmington, Del., U.S.A.). However, such materials generally have electrical properties that are inferior to polyolefin materials.

The present invention is directed to overcoming, or at least reducing, the effects of one or more of the problems set forth above.

BRIEF SUMMARY OF THE INVENTION

In one aspect of the present invention, an electrical cable is provided. The electrical cable includes a first layer, a second layer, and a tie layer, disposed between the first layer and the second layer, for bonding the first layer to the second layer.

In another aspect of the present invention, a method of making an electrical cable is provided. The method includes applying a tie layer to an inner layer, the tie layer being miscible with the inner layer, and bonding an outer layer to the tie layer via one of a chemical reaction therebetween and a physical bond therebetween.

In yet another aspect of the present invention, an electrical cable is provided. The electrical cable includes a first layer, a second layer immiscible with the first layer, and a tie layer disposed between the first layer and the second layer, wherein the tie layer is miscible with the first layer and is capable of bonding with the second layer.

In another aspect of the present invention, an electrical cable is provided. The electrical cable includes a first layer and a second layer bonded to the first layer comprising a polymer and at least one of an unsaturated anhydride, an acrylic acid, a carboxyl acid, a silane, and a vinyl acetate.

BRIEF DESCRIPTION OF THE DRAWINGS

The invention may be understood by reference to the following description taken in conjunction with the accompanying drawings, in which the leftmost significant digit in the reference numerals denotes the first figure in which the respective reference numerals appear, and in which.

Figure 1:
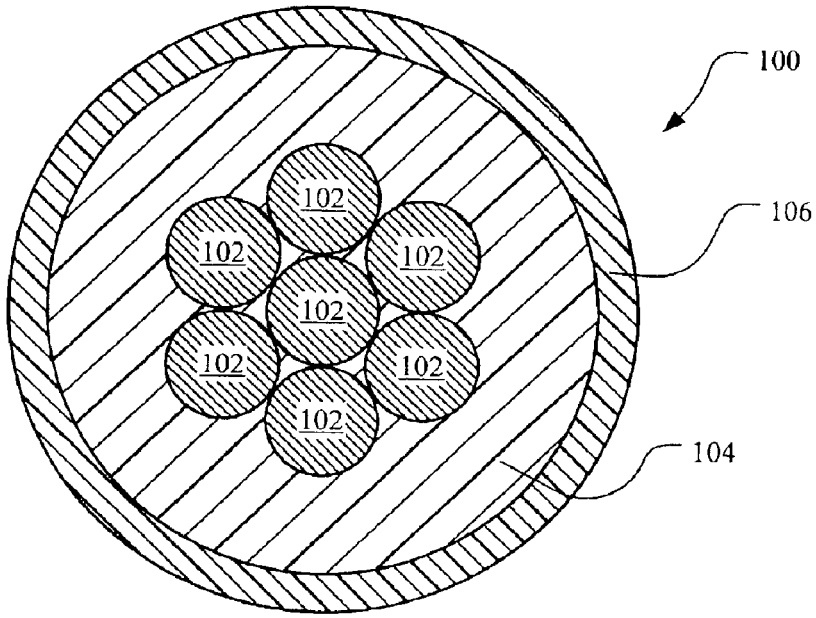
FIG. 1 is a cross-sectional view of a first illustrative embodiment of an electrical cable according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but, on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 depicts, in cross-section, a first illustrative embodiment of an electrical cable according to the present invention. In the illustrated embodiment, an electrical cable 100 includes a plurality of electrical conductors 102, an insulating layer 104, and a tie layer 106. The plurality of electrical conductors 102 may be individually-insulated conductors (e.g., a plurality of twisted pairs), strands of an electrical conductor, or a combination of both. The insulating layer 104 electrically isolates the plurality of electrical conductors 102 and is disposed between the plurality of electrical conductors 102 and the tie layer 106. The insulating layer 104 may be made of any chosen polyolefin, polyolefin co-polymer, or fluoropolymer material suitable for electrically isolating the plurality of electrical conductors 102, e.g., polyethylene, polypropylene, ethylene propylene co-polymer, ethylene vinyl acetate, methylpentene co-polymer, e.g., TPX® from Mitsui Chemicals America, Inc. of Purchase, New York, U.S.A., polytetrafluoroethylene/perfluoromethylvinylether co-polymer, ethylene tetrafluoroethylene, perfluoroalkoxy polymer, or fluorinated ethylene propylene.

It is often desirable to bond potting material layers to insulating layers in electrical cable terminations or to bond jacketing layers to insulating layers. However, polyolefin and fluoropolymer materials are not readily bonded, except with cyanoacrylate adhesives, and such adhesives are often brittle and are not capable of withstanding the temperature and/or pressure cycling requirements of some electrical cables, such as seismic, oceanographic, and wireline cables. Accordingly, the illustrated embodiment shown in FIG. 1 includes the tie layer 106, which is miscible with the insulating layer 104 and readily bonds to potting materials and jacketing layer materials. In various embodiments, the tie layer 106 may comprise a material in the same polymer family as the insulating layer 104 that has been modified to include a functional group capable of interacting physically (e.g., via polar bonds) or chemically (e.g., via a chemical reaction) with the potting material or jacketing layer materials.

Figure 2:
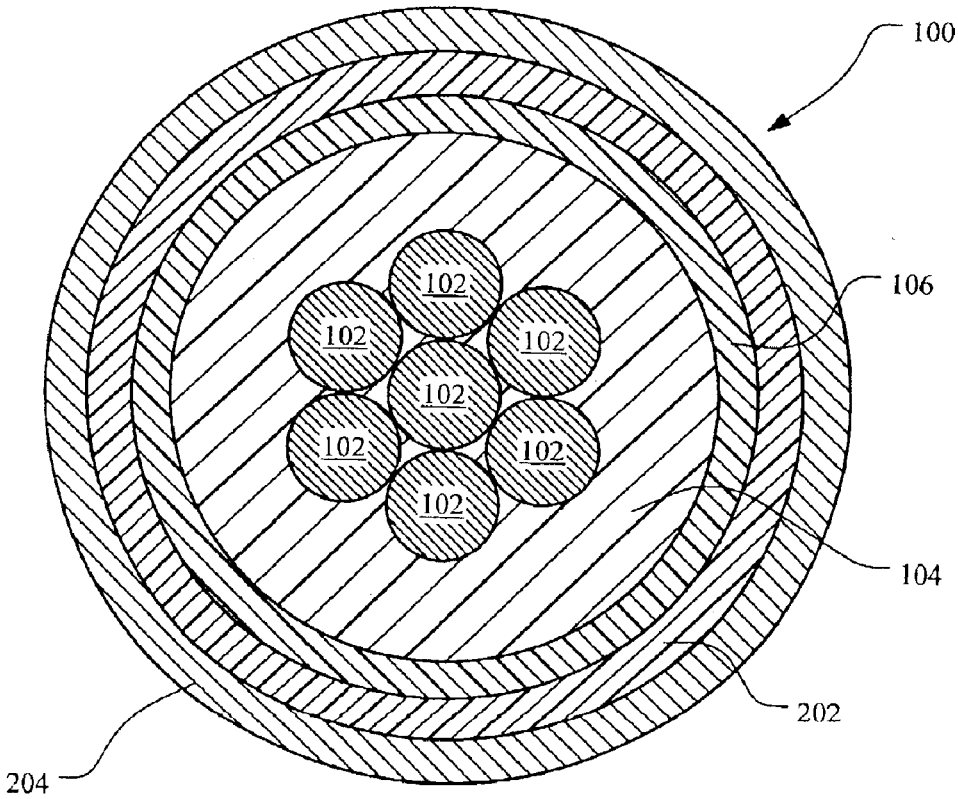
FIG. 2 is a cross-sectional view of the electrical cable of FIG. 1 potted to a connector.

For example, as shown in FIG. 2, a potting material layer 202 is disposed between the tie layer 106 and, for example, a connector 204 for bonding the cable 100 to the connector 204. In various embodiments, the potting material 202 may comprise epoxy-, nitrile-, ester-, or urethane-based potting materials. In on embodiment, the insulating layer 104 comprises polyethylene and the tie layer 106 comprises a modified polyethylene material grafted with an unsaturated anhydride (e.g., maleic anhydride or norbornene-2, 3-dicarboxylic anhydride), an acrylic acid, a carboxyl acid, or a silane. In another embodiment, the insulating layer 104 comprises polypropylene and the tie layer 106 comprises a modified polypropylene material grafted with an unsaturated anhydride, an acrylic acid, a carboxyl acid, or a silane.

In yet another embodiment, the insulating layer 104 comprises ethylene-propylene co-polymer and the tie layer 106 comprises a modified ethylene propylene co-polymer material grafted with an unsaturated anhydride, an acrylic acid, a carboxyl acid, or a silane. In still another embodiment, the insulating layer 104 comprises ethylene vinyl acetate and the tie layer 106 comprises an ethylene vinyl acetate material modified with, for example, a carboxyl acid or an acrylic acid. In yet another embodiment, the insulating layer 104 comprises methylpentene co-polymer and the tie layer 106 comprises a modified methylpentene co-polymer material grafted with an unsaturated anhydride or a silane.

Still referring to FIG. 2, it may be desirable for the insulating layer 104 to comprise a fluoropolymer. In one embodiment, the insulating layer 104 comprises ethylene tetrafluoroethylene and the tie layer 106 comprises a modified ethylene tetrafluoroethylene material grafted with a carboxyl, a carboxyl salt, a carboxyl acid, or an unsaturated anhydride.

Figure 3:
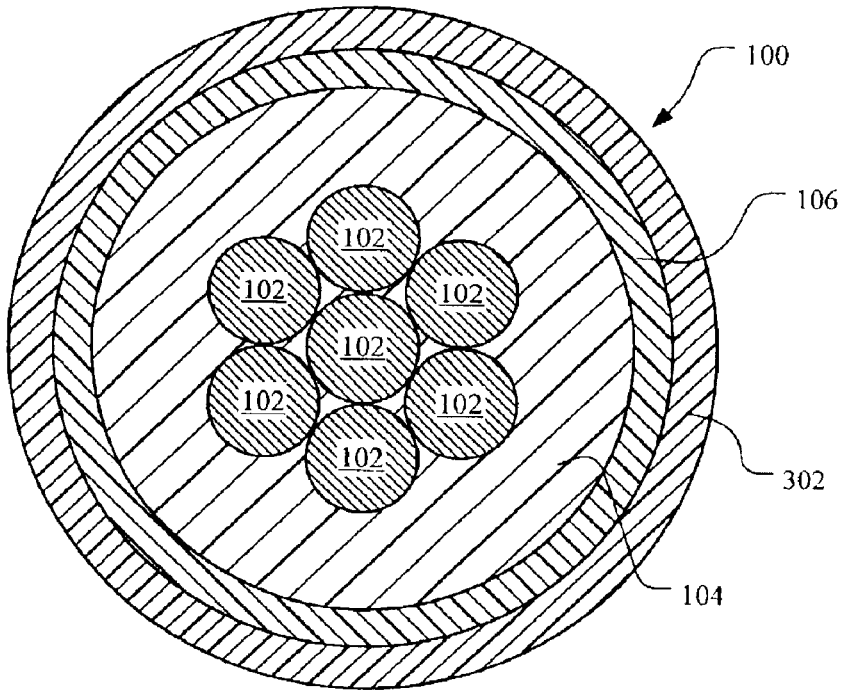
FIG. 3 is a cross-sectional view of the electrical cable of FIG. 1 having a polymeric jacketing layer.

Alternatively, it may be desirable to bond the insulating layer 104 to a polymeric jacketing layer 302, comprising a material such as, for example, nylon, polyphenylene sulfide, polyurethane, or ethylene vinyl alcohol co-polymer, as shown in FIG. 3. Such jacketing materials are advantageous in that they are resistant to attack by many chemicals and, thus, are capable of protecting the insulating layer 104 from degradation. In various embodiments, the insulating layer 104 comprises polyethylene and the jacketing layer 302 comprises nylon, polyphenylene sulfide modified with a functionalized polyethylene group (e.g., Fortron SKX-382®, provided by Ticona of Summit, N.J. U.S.A.), polyurethane, or ethylene vinyl alcohol co-polymer. In such embodiments, the tie layer 106 may comprise materials as shown in Table 1.

TABLE 1

Tie layer 106 materials for an insulating layer 104 comprising polyethylene.

| Jacketing layer 302 | Tie layer 106 |
|---|---|
| Nylon | Polyethylene grafted with an unsaturated anhydride, an acrylic acid, a carboxyl acid, or a silane. Ethylene vinyl acetate grafted with an unsaturated anhydride. |
| Polyethylene modified polyphenylene sulfide | Polyethylene grafted with an unsaturated anhydride, an acrylic acid, a carboxyl acid, or a silane. |
| Polyurethane | Polyethylene or ethylene vinyl acetate grafted with an unsaturated anhydride. |
| Ethylene vinyl alcohol co-polymer | Polyethylene grafted with an unsaturated anhydride, an acrylic acid, a carboxyl acid, or a silane. Ethylene vinyl acetate grafted with an unsaturated anhydride. |

In other embodiments, the insulating layer 104 comprises polypropylene and the jacketing layer 302 comprises nylon, polyphenylene sulfide modified with a polyethylene functional group, polyurethane, or ethylene vinyl alcohol co-polymer. In such embodiments, the tie layer 106 may comprise materials as shown in Table 2.

TABLE 2

Tie layer 106 materials for an insulating layer 104 comprising polypropylene.

| Jacketing layer 302 | Tie layer 106 |
|---|---|
| Nylon | Polypropylene grafted with an unsaturated anhydride, an acrylic acid, a carboxyl acid, or a silane. |
| Polyethylene modified polyphenylene sulfide | Polypropylene grafted with an unsaturated anhydride, an acrylic acid, a carboxyl acid, or a silane. |
| Polyurethane | Polypropylene grafted with an unsaturated anhydride. |
| Ethylene vinyl alcohol co-polymer | Polypropylene grafted with an unsaturated anhydride, an acrylic acid, a carboxyl acid, or a silane. |

Alternatively, the insulating layer 104 may comprise ethylene propylene co-polymer and the jacketing layer 302 may comprise nylon, polyphenylene sulfide modified with a polyethylene functional group, polyurethane, or ethylene vinyl alcohol co-polymer. In such embodiments, the tie layer 106 may comprise materials as shown in Table 3.

TABLE 3

Tie layer 106 materials for an insulating layer 104 comprising ethylene propylene co-polymer.

| Jacketing layer 302 | Tie layer 106 |
|---|---|
| Nylon | Ethylene propylene co-polymer grafted with an unsaturated anhydride, an acrylic acid, a carboxyl acid, or a silane. |
| Polyethylene modified polyphenylene sulfide | Ethylene propylene co-polymer grafted with an unsaturated anhydride, an acrylic acid, a carboxyl acid, or a silane. |
| Polyurethane | Ethylene propylene co-polymer grafted with an unsaturated anhydride. |
| Ethylene vinyl alcohol co-polymer | Ethylene propylene co-polymer grafted with an unsaturated anhydride, an acrylic acid, a carboxyl acid, or a silane. |

In other embodiments, the insulating layer 104 comprises ethylene vinyl acetate and the jacketing layer 302 comprises nylon, polyphenylene sulfide modified with a polyethylene functional group, polyurethane, or ethylene vinyl alcohol co-polymer. In such embodiments, the tie layer 106 may comprise materials as shown in Table 4.

TABLE 4

Tie layer 106 materials for an insulating layer 104 comprising ethylene vinyl acetate.

| Jacketing layer 302 | Tie layer 106 |
|---|---|
| Nylon | Ethylene vinyl acetate grafted with an unsaturated anhydride, an acrylic acid, or a carboxyl acid. |
| Polyethylene modified polyphenylene sulfide | Ethylene vinyl acetate grafted with an unsaturated anhydride, an acrylic acid, a carboxyl acid, or a silane. |
| Polyurethane | Ethylene vinyl acetate grafted with an unsaturated anhydride. |
| Ethylene vinyl alcohol co-polymer | Ethylene vinyl acetate grafted with an unsaturated anhydride, an acrylic acid, a carboxyl acid, or a silane. |

In yet other embodiments, the insulating layer 104 comprises methylpentene co-polymer and the jacketing layer 302 comprises nylon, polyphenylene sulfide modified with a polyethylene functional group, polyurethane, or ethylene vinyl alcohol co-polymer. In such embodiments, the tie layer 106 may comprise materials as shown in Table 5.

TABLE 5

Tie layer 106 materials for an insulating layer 104 comprising methylpentene co-polymer.

| Jacketing layer 302 | Tie layer 106 |
|---|---|
| Nylon | Methylpentene co-polymer grafted with an unsaturated anhydride. |
| Polyethylene modified polyphenylene sulfide | Methylpentene co-polymer grafted with an unsaturated anhydride. |
| Polyurethane | Methylpentene co-polymer grafted with an unsaturated anhydride. |
| Ethylene vinyl alcohol co-polymer | Methylpentene co-polymer grafted with an unsaturated anhydride, an acrylic acid, a carboxyl acid, or a silane. |

In other embodiments, the insulating layer 104 comprises ethylene tetrafluoroethylene and the jacketing layer 302 comprises nylon, polyphenylene sulfide modified with a polyethylene functional group, or ethylene vinyl alcohol co-polymer. In such embodiments, the tie layer 106 may comprise ethylene tetrafluoroethylene grafted with a carboxyl, a carboxyl salt, a carboxyl acid, or an unsaturated anhydride, e.g., Tefzel HT-2202, provided by E. I. du Pont de Nemours and Company.

Figure 4:
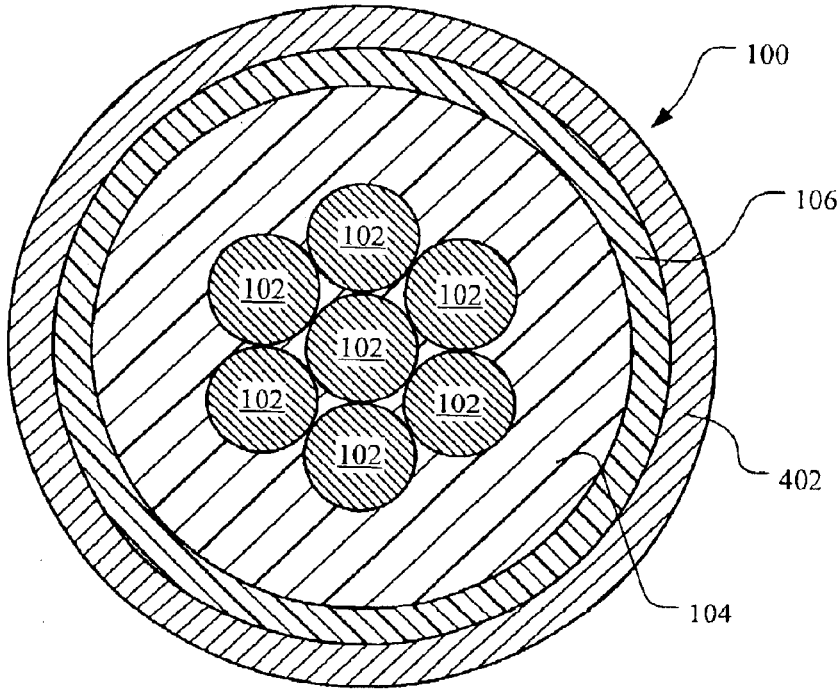
FIG. 4 is a cross-sectional view of the electrical cable of FIG. 1 having a metallic jacketing layer.

Alternatively, it may be desirable to bond the insulating layer 104 to a metallic jacketing layer 402, comprising a material such as, for example, aluminum, stainless steel, and tin-plated steel, as shown in FIG. 4. Such jacketing materials are advantageous in that they are capable of protecting the insulating layer 104 from mechanical damage. In various embodiments having a metallic jacketing layer 402, the insulating layer 104 may comprise polyethylene, polypropylene, ethylene propylene co-polymer, methylpentene co-polymer, or ethylene tetrafluoroethylene. In such embodiments, the tie layer 106 may comprise the material of the insulating layer 104 (e.g., polyethylene, polypropylene, ethylene propylene co-polymer, methylpentene co-polymer, or ethylene tetrafluoroethylene) grafted with an unsaturated anhydride, an acrylic acid, a carboxyl acid, or a silane.

Figure 5:
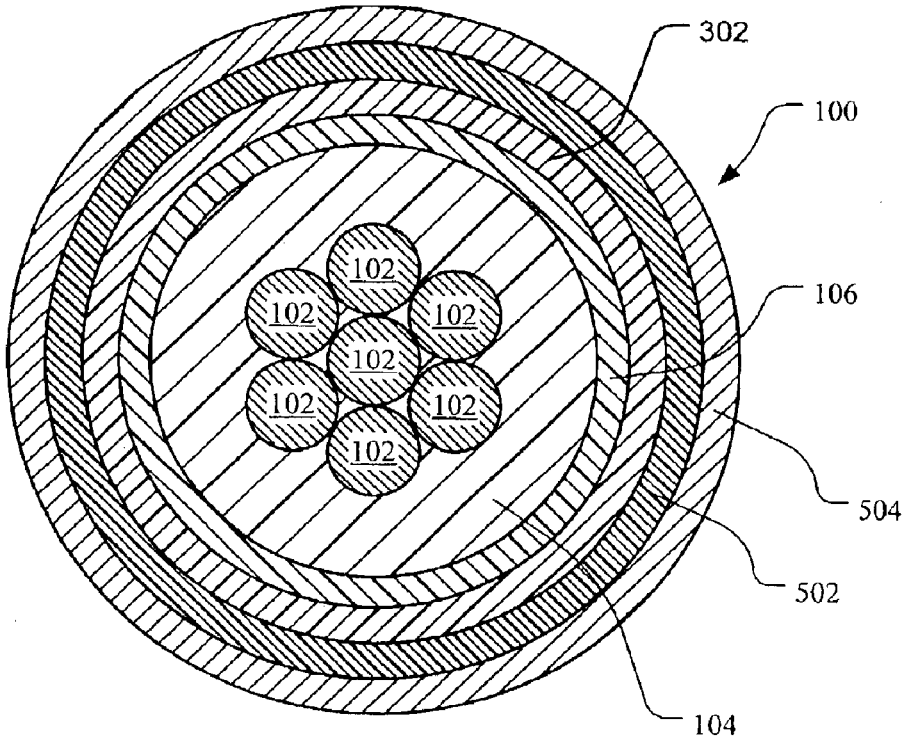
FIG. 5 is a cross-sectional view of the electrical cable of FIG. 3 potted to a connector.

It may be desirable in certain applications to pot or attach the cable 100 of FIG. 3 or FIG. 4 to a connector. Accordingly, FIG. 5 illustrates a potting layer 502 disposed between the jacketing layer 302 and a connector 504. While the jacketing layer 302 is illustrated in FIG. 5 as comprising a polymeric material, the present invention is not so limited. Rather, the connector 504 may be attached via the potting layer 502 to a metallic jacketing layer, such as the metallic jacketing layer 402 of FIG. 4. The potting layer 502 may comprise a material corresponding to the potting layer 202 of FIG. 2, or another material.

Figure 6:
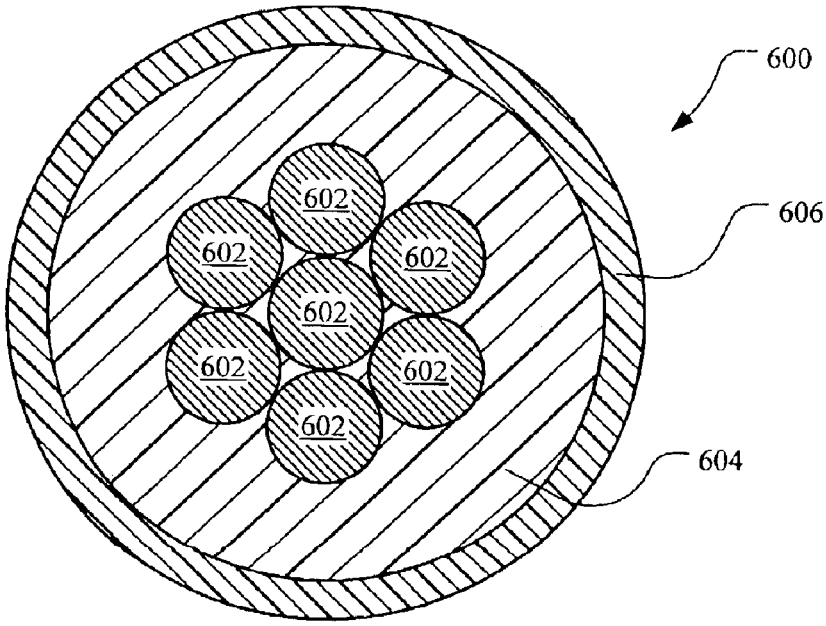
FIG. 6 is a cross-sectional view of a second illustrative embodiment of a cable according to the present invention.

It may also be desirable in certain situations to incorporate a tie layer material, such as that of the tie layer 106, into the insulating layer 104 (shown in FIGS. 1–5) and/or the jacketing layer 302 (shown in FIGS. 3 and 5). Accordingly, FIG. 6 depicts a second illustrative embodiment of a cable 600 according to the present invention. The cable 600 comprises a plurality of conductors 602, which may correspond to the conductors 102 of FIGS. 1–5. The cable 600 further comprises an insulating layer 604 disposed around the conductors 602 and a jacketing layer 606 disposed on the insulating layer 604.

Still referring to FIG. 6, in one embodiment, a tie layer material is included in one of the insulating layer 604 and the jacketing layer 606 as a mixture. In various embodiments, one of the insulating layer 604 and the jacketing layer 606 may comprise a polymer and at least one of an unsaturated anhydride, an acrylic acid, a carboxyl acid, a silane, and a vinyl acetate. In one embodiment, one of the insulating layer 604 and the jacketing layer 606 comprises nylon and the other layer comprises a mixture of polyethylene and a polyethylene grafted with an unsaturated anhydride. In another embodiment, one of the insulating layer 604 and the jacketing layer 606 comprises nylon and the other layer comprises a mixture of ethylene propylene co-polymer and an ethylene propylene co-polymer grafted with an unsaturated anhydride.

In yet another embodiment, one of the insulating layer 604 and the jacketing layer 606 comprises polyethylene and the other layer comprises a mixture of nylon and a polyethylene grafted with an unsaturated anhydride. In another embodiment, one of the insulating layer 604 and the jacketing layer 606 comprises ethylene propylene co-polymer and the second layer comprises a mixture of nylon and an ethylene propylene co-polymer grafted with an unsaturated anhydride. In each of the embodiments relating to FIG. 6, the insulating layer 604 or the jacketing layer 606 may comprise a polymer grafted with an unsaturated anhydride within a range of about 20 weight percent of the layer to about 80 weight percent of the layer containing the mixture.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An electrical cable, comprising:

a first layer comprising a methylpentene co-polymer;

a second layer comprising a material selected from the group consisting of an epoxy-based potting material, a nitrile-based potting material, an ester-based potting material, and a urethane-based potting material; and a tie layer, disposed between the first layer and the second layer, for bonding the first layer to the second layer, the tie layer comprising the methylpentene co-polymer grafted with one of an unsaturated anhydride or a silane.

2. An electrical cable, comprising:

a first layer comprising a fluoropolymer;

a second layer comprising a material selected from the group consisting of an epoxy-based potting material, a nitrile-based potting material, an ester-based potting material, and a urethane-based potting material; and a tie layer comprising the fluoropolymer grafted with a material selected from the group consisting of a carboxyl, a carboxyl salt, a carboxyl acid, or an unsaturated anhydride.

3. An electrical cable comprising:

a first layer comprising methylpentene co-polymer;

a second layer comprising a material selected from the group consisting of a metal, nylon, a polyphenylene sulfide material, polyurethane, and ethylene vinyl alcohol co-polymer; and a tie layer comprising methylpentene co-polymer grafted with an unsaturated anhydride.

4. An electrical cable comprising:

a first layer comprising methylpentene co-polymer;

a second layer comprising one of a metal and ethylene vinyl alcohol co-polymer; and a tie layer comprising methylpentene co-polymer grafted with a material selected from the group consisting of an acrylic acid, a carboxyl acid, and a silane.

5. An electrical cable comprising:

a first layer comprises ethylene tetrafluoroethylene;

a second layer comprises a material selected from the group consisting of a metal, nylon, a polyphenylene sulfide material, and ethylene vinyl alcohol co-polymer; and a tie layer comprises ethylene tetrafluoroethylene grafted with a material selected from the group consisting of a carboxyl, a carboxyl salt, a carboxyl acid, and an unsaturated anhydride.

6. An electrical cable, comprising:

a first layer comprising a mixture of ethylene propylene co-polymer and an ethylene propylene co-polymer grafted with an unsaturated anhydride and a second layer bonded to the first layer, the second layer comprises nylon.

7. An electrical cable, comprising:

a first layer comprising a material selected from the group consisting of polyethylene and ethylene propylene co-polymer; and a second layer bonded to the first layer, the second layer comprising a mixture of nylon and a material selected from the group consisting of a polyethylene grafted with an unsaturated anhydride and an ethylene propylene co-polymer grafted with an unsaturated anhydride.

* * * * *